United States Patent [19]

Griffith et al.

[11] 4,288,140

[45] Sep. 8, 1981

[54] PRINTED WIRING BOARD INTERCONNECTION APPARATUS

[75] Inventors: Gary L. Griffith, Arvada, Colo.; Richard G. Johnsen, Wheaton, Ill.; Charles J. Sherman, Westminster, Colo.

[73] Assignee: Bell Telephone Laboratories, Incorporated, Murray Hill, N.J.

[21] Appl. No.: 105,494

[22] Filed: Dec. 20, 1979

[51] Int. Cl.[3] ..... H01R 13/62

[52] U.S. Cl. ..... 339/74 R

[58] Field of Search ..... 339/74 R, 75 R, 75 M, 339/75 MP, 176 MP, 184

[56] References Cited

U.S. PATENT DOCUMENTS

| | | | |
|---|---|---|---|
| 3,188,598 | 6/1965 | Pferd | 339/74 R |
| 3,594,699 | 7/1971 | Jayne et al. | 339/75 MP |
| 3,710,303 | 1/1973 | Gallager, Jr. | 339/75 MP |
| 4,002,381 | 1/1977 | Wagner | 312/183 |
| 4,018,495 | 4/1977 | Freitag | 339/17 L |

*Primary Examiner*—Joseph H. McGlynn
*Attorney, Agent, or Firm*—William H. Kamstra

[57] ABSTRACT

A printed wiring board (20) and housing (12) apparatus in which a coordinate array of terminal contact areas (22) on the board (20) make only simultaneous and exclusive electrical contact with a corresponding array of housing contact springs (42). Premature and unwanted electrical contacts are prevented as the board (20) is moved into association with housing (12) by cam means (40) protruding from each end of a lattice structure (33). Crossmembers (36, 37, 38) of the lattice structure (33) support spring ends (45) to maintain the contact surfaces of the springs (42) out of engagement with the board (20) contact areas (22) as the cams (40) ride along the surface of the board (20) until full insertion movement of the board is completed. At this point, the cams (40) are seated in corresponding recesses (46) provided therefor in the board (20) to permit the mating of the contact areas and housing springs.

10 Claims, 8 Drawing Figures

PRINTED WIRING BOARD INTERCONNECTION APPARATUS

TECHNICAL FIELD

This invention relates to electrical interconnection apparatus and particularly to such apparatus for interconnecting electrical assemblies, such as printed wiring boards, for example, and other electrical system components and circuits.

BACKGROUND OF THE INVENTION

Printed wiring boards and their mounting frames of the character described, for example, in U.S. Pat. No. 4,002,381 of D. R. Wagner et al., issued Jan. 11, 1977, are well-known in the art and have long provided an advantageous means for assembling and mounting relatively large numbers of electrical components. Typically, circuits extending from the components in the form of wiring printed on the board are extended to terminal contact areas arranged along a leading edge of the board. These terminal areas are spaced to mate with corresponding contact springs of a connector into which the leading edge of the board is inserted. Suitable frames and racks are provided to support a number of the boards and also provide a means for guiding the boards for their insertion in and removal from the respective connectors. The connectors are in turn adapted to mate with pins extending from a backplane or with other interconnection apparatus as is also known. In order to achieve an orderly physical organization, the dimensions of the printed wiring boards are generally standardized within a given system and may even be so standardized among various suppliers. Although convenient from an interchangeability viewpoint, the fixed dimensions of a board within a given system and particularly the dimension of the board leading edge, ultimately imposes a severe limitation on the number of terminal contact areas which may be provided. This in turn limits the number of electrical components and circuits which may be mounted on the board notwithstanding the available board mounting area.

One obvious expedient in providing more board leading edge terminal contact areas is to decrease their widths and spacings; this measure, however, is temporary as minimum limits of the contact areas and spacings are approached. Additional columns of contact areas have in the past also been provided inwardly from the board leading edge, the resulting array of contact areas then being adapted to mate with multiple tiers of connector springs. Although significantly increasing the number of circuit board terminations, the latter arrangement presents a problem not encountered in connection with boards having a single leading edge column of terminal contact areas. When a single column board is inserted in its connector, each of its contact areas simultaneously makes electrical contact with its corresponding connector contact spring. No premature or erroneous electrical connections are normally possible during the time the board is being inserted. In a multicolumn contact arrangement, on the other hand, the connector contact springs adapted to make electrical connections with the contact areas of the circuit board beyond the first column of necessity pass each contact area of the preceding columns. Were the connector contact springs actually to wipe such preceding column board contact areas, serious damage could be done to board circuit components where the connector springs are included in active circuits. It is thus necessary in many system applications that the connector contact springs make simultaneous electrical contact with their respective circuit board terminal contact areas only at such time as the board is fully inserted in final opposition with the array of contact springs.

In one prior art interconnection arrangement, that disclosed in U.S. Pat. No. 4,018,495 of W. O. Freitag issued Apr. 19, 1977, a rider spring associated with the electrical contact spring prevents contact of the latter with a circuit board contact area until a predetermined point on the contact area is reached. The rider spring is adapted to slide along the board surface thereby maintaining the contact spring out of contact with the board contact area until a recess provided in the board surface receives the rider spring. At that time, the electrical connection is completed. Only a single electrical connection is thus made at a predetermined point in the relative movement of the circuit board and contact spring. It is thus the problem of achieving selective and simultaneous contact of an array of circuit board contact areas and a corresponding array of contact springs to which the apparatus of this invention is chiefly directed.

SUMMARY OF THE INVENTION

The foregoing objective is realized and a technical advance is achieved in accordance with the principles of this invention in printed wiring boardconnector apparatus in which the board and connector contact area and spring pairs make selective and simultaneous electrical contact only when the board completes full insertion in its connector. As exemplified in various specific embodiments, the apparatus of the invention broadly comprises a printed wiring board having a coordinate array of terminal contact areas affixed at its leading edge portion at least on one side, the columns being arranged inwardly from the leading edge. The board is adapted for insertion in a connector housing supporting a corresponding array of contact springs arranged to mate with respective board contact areas. The springs conventionally terminate in pins adapted and spaced for insertion in via holes of a backplane or other electrical interconnection apparatus. According to the invention, as the board is inserted into its connector housing, simultaneous and exclusive mating of its contact areas and the housing contact springs is achieved at the completion of the insertion by a lattice structure supporting the spring ends which, during the board insertion, maintains all of the springs out of contact with the board contact areas. Cam means at each end of the lattice structure slide along the board surface until corresponding recesses provided in the board are reached at the completion of its insertion. At this point, the cams fall into the recesses thereby simultaneously lowering all of the spring contact surfaces into electrical contact with the corresponding board terminal contact areas. Advantageously, in the interconnection apparatus of the invention, any active circuits presented by the contact springs are completed exclusively with the desired printed wiring board circuits and components.

BRIEF DESCRIPTION OF THE DRAWING

The organization and operation of the electrical interconnection apparatus according to this invention together with its features will be better understood from a consideration of the detailed description of an illustrative embodiment thereof which follows when taken in conjunction with the accompanying drawing in which.

DETAILED DESCRIPTION

Figure 1:
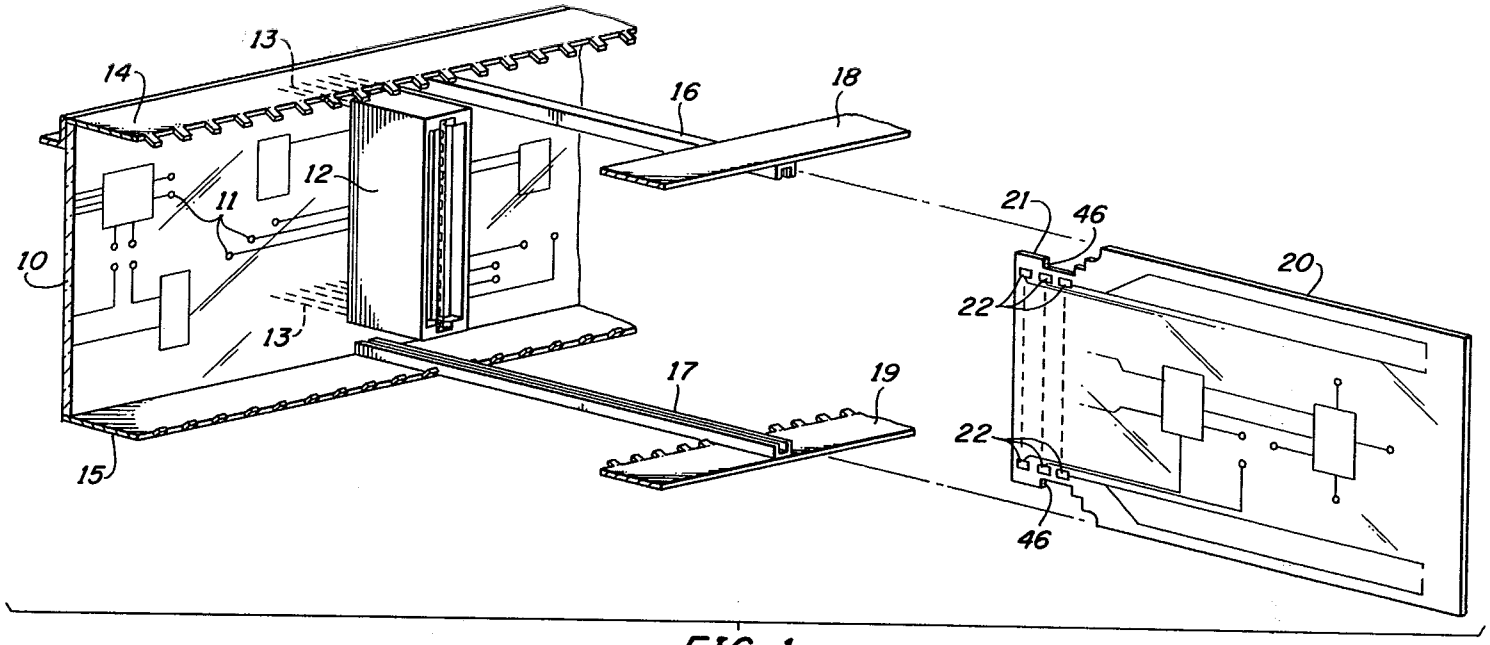
FIG. 1 depicts a representative backplane connector organization showing a connector housing and a printed wiring board according to the invention, the connector housing being shown in place at the backplane in relation to portions of a frame assembly and the wiring board being shown in alignment with guide rails preparatory to its insertion therebetween.
Figure 2:
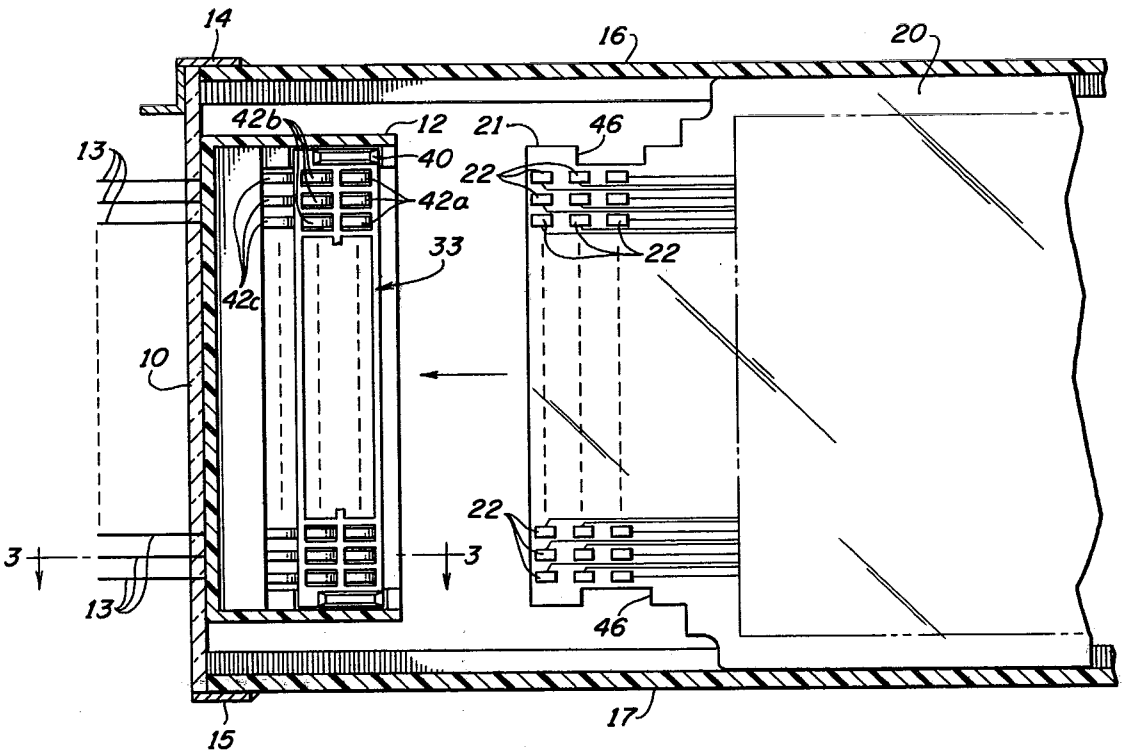
FIG. 2 is an enlarged section view of the assembly of FIG. 1 showing the printed wiring board in place between sectioned guide rails preparatory to its final movement into association with a connector contact spring housing, the view showing one contact area face of the board.

A portion of a typical backplane interconnection organization in which a connector-printed wiring board apparatus of the invention is advantageously adapted for use is depicted in FIG. 1. This organization may comprise a backplane 10 which itself may have mounted thereon printed wiring interconnecting an array of via holes 11 adapted to receive the pins of a printed wiring board connector. A single illustrative connector housing 12 having representative pins 13 so inserted in holes 11 is shown mounted on the backplane 10 between a pair of frame members 14 and 15 and a pair of guide rails 16 and 17. Guide rails 16 and 17 are mounted at one end between frame members 14 and 15, respectively, and at the other end between other frame members 18 and 19, representative portions of which are shown in the figure. A printed wiring board 20 featuring a leading edge portion 21 according to specific embodiments of the invention is shown in alignment with guide rails 16 and 17 preparatory to its insertion therebetween. A board 20, a specific illustrative one of which is also shown in enlarged view of FIG. 2 as partially inserted between rails 16 and 17, has affixed thereto at leading edge portion 21 on each side a coordinate array of terminal contact areas 22. The latter are typically connected by means of printed wiring to circuits and components mounted on the remaining portions of the board. Board 20 is shown in FIG. 2 between sectioned guide rails 16 and 17 in a position just before its final insertion in its connector housing 12. Details of the latter housing are more clearly shown in FIGS. 3 and 4 to which figures reference may now be had.

Figure 3:
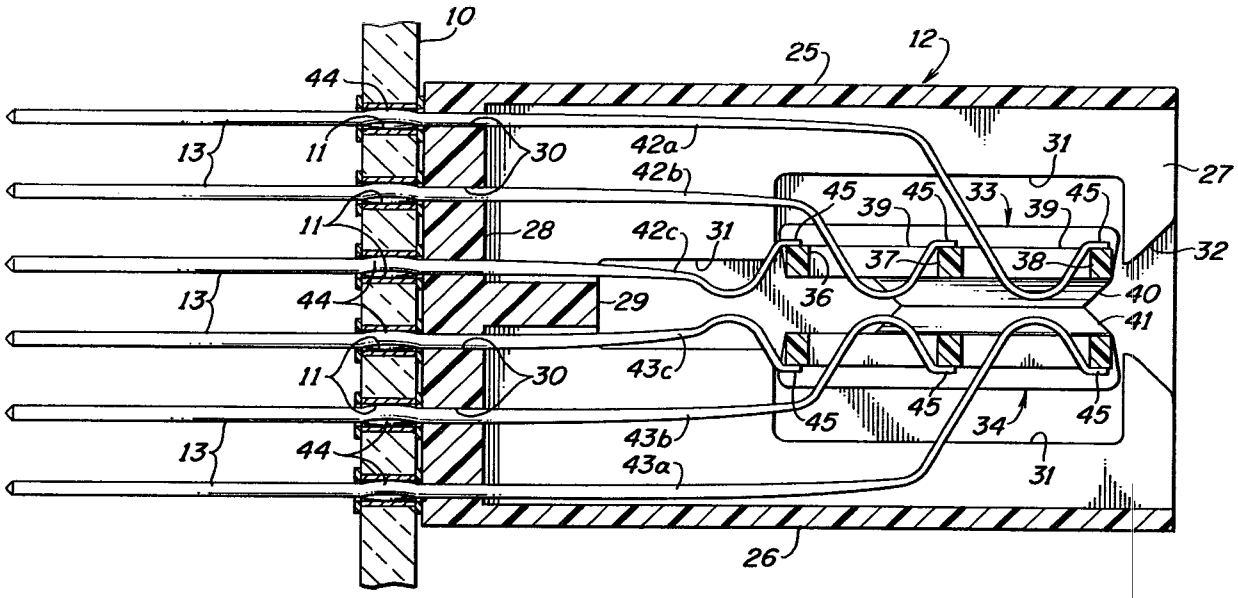
FIG. 3 is an enlarged section view of the connector housing of FIG. 2 taken along the line 3—3.
Figure 4:
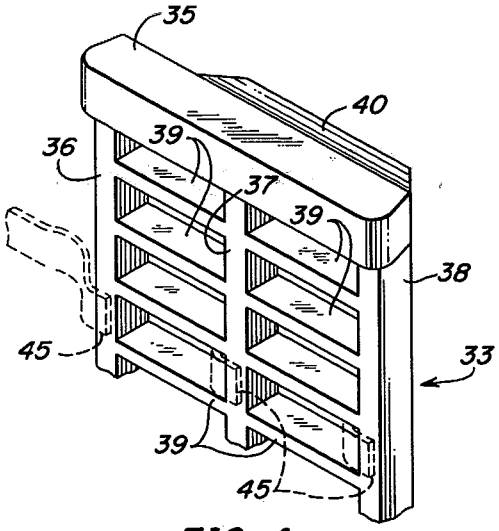
FIG. 4 is an enlarged view of a portion of a lattice structure for supporting the contact springs of the apparatus according to the invention, the crossbars of which are shown in section in FIG. 3, the figure also showing in dashed outline portions of representative contact spring ends.

Housing 12, only a top section view of which is sufficient for an understanding of its organization, is formed of an electrically insulative material and comprises a pair of side walls 25 and 26 and end walls, only end wall 27 being visible in the figure. The enclosure of housing 12 is completed by a base wall 28 having at its midpoint an outwardly extending shelf 29 which may conveniently constitute a stop for the insertion of a board 20. Base wall 28 is provided with an array of apertures 30 which correspond in arrangement and spacing to those of via holes 11 presented on backplane 10. Apertures 30, a single representative column of which is shown in FIG. 3, are dimensioned to have press-fitted therethrough the connector contact springs which terminate in pins 13 there shown as fitted in via holes 11 of backplane 10. The illustrative details of housing 12 further include a recess 31 formed in the end walls (see end wall 27) extending from shelf 29 to the open end of the housing and terminating in a broadly tapered access 32. Slot 31 on each end wall 27 is configured to receive the end members of a pair of lattices 33 and 34, the details of which are more clearly seen in FIG. 4 where a portion of lattice 33 is shown. Lattice 33 (as well as lattice 34) is formed of any suitable electrically insulative material and comprises a pair of end members, such as end member 35 adapted to freely ride in slot 31. Extending between the end members are a plurality (in this case, three, for reasons which will appear hereinafter) of crossbars 36, 37, and 38 having evenly spaced therebetween a plurality of spacing members 39. Each of the end members (see end member 35) has extending therefrom a cam 40 having tapered sides. As shown in FIG. 3, lattices 33 and 34 are initially fitted in slot 31 with cams 40 and 41 maintained in abutment by the spring action of six tiers of contact springs presented within housing 12, representative single springs **42*a*, 42*b*, and 42*c* of which are shown on one side of housing 12 and representative single springs 43*a*, 43*b*, and 43*c* of which are shown on the other side of housing 12. The springs individually extend outwardly from base wall 28 and are end-curved to present an array of contact surfaces coinciding in position with the array of contact areas 22 of board 20. Springs 42 and 43, as mentioned hereinbefore, terminate in terminal pins 13 and are adapted to maintain positive electrical connection with via holes 11 of backplane 10 by split-beam sections 44, which sections are well-known. The widths of the contact surfaces of springs 42 and 43 and the distances between spacing members 39 of lattice 33 are determined so that the surfaces are freely movable between members 39. Springs 42 and 43 terminate in riders 45 which are supported by crossbars 36, 37, and 38 of the lattices as shown in dashed outline in FIG. 4, which riders apply the spring action to maintain cams 40 and 41** in initial abutment as mentioned hereinbefore.

Figure 5:
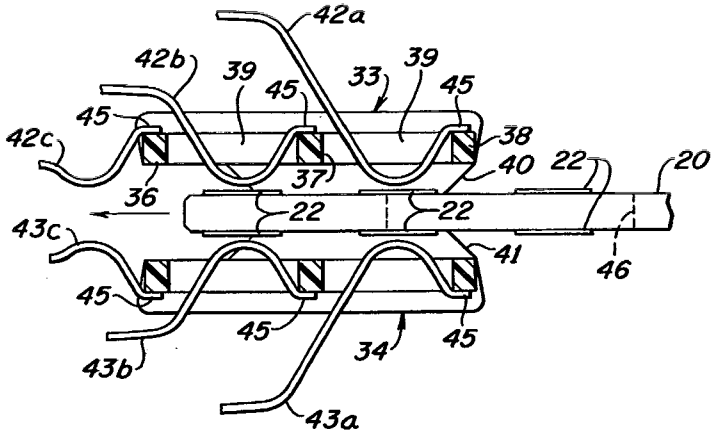
FIG. 5 shows in enlarged section view a portion of an interconnection apparatus according to the invention, a printed wiring board being depicted in top view during its insertion in the direction indicated just prior to the completion of its insertion movement.
Figure 6:
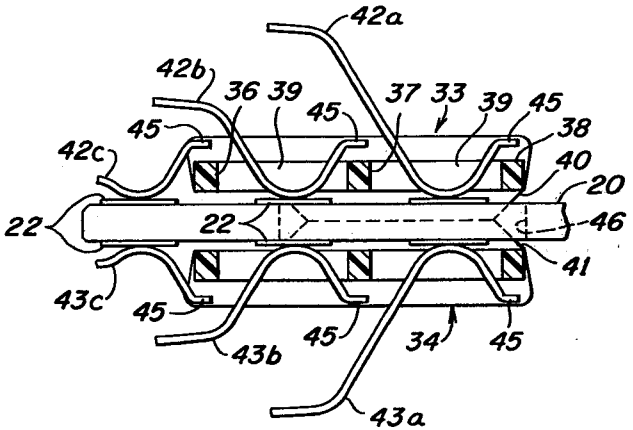
FIG. 6 depicts the same structure as that of FIG. 5, the printed wiring board being shown at the completion of its insertion movement.

Returning to printed wiring board 20, it is seen in FIGS. 1 and 2 that two recesses or notches 46 are provided at the end portion and at each side of the board. Notches 46 are dimensioned to freely admit cams 40 and 41 of the lattices 33 and 34 and are spaced inwardly from the leading edge of board 20 so that the cams are received in notches 46 when the printed wiring board is fully inserted in housing 12. As mentioned hereinbefore, cams 40 and 41 are shown initially in abutment in FIG. 3, the housing contact springs at either side of housing 12 being maintained out of contact by their riders 45 resting on spacing members 36, 37, and 38 of lattice 33 and the corresponding members of lattice 34. As board 20 begins its insertion into housing 12, its leading portion urges cams 40 and 41 apart facilitated by the tapered forward side of the cams. Cams 40 and 41 then are slid along the opposing surfaces of board 20 as the insertion movement continues (FIG. 5), the contact springs being maintained out of engagement with the board contact areas 22 by the crossbars of lattices 33 and 34. As board 20 completes its travel (FIG. 6), cams 40 and 41 simultaneously fall into recess 46 at one side and into the corresponding recess at the other side of the board from opposite openings of the recesses. As the cams are so admitted, the spring action of the housing contact springs simultaneously urges the spring contact surfaces into engagement with the board contact areas 22 as the spring riders 45 and the lattice crossbars no longer prevent this engagement. Both arrays of contact springs and board contact areas thus are advantageously brought into selective and simultaneous electrical contact only at the complete insertion of board 20 into housing 12.

Figure 7:
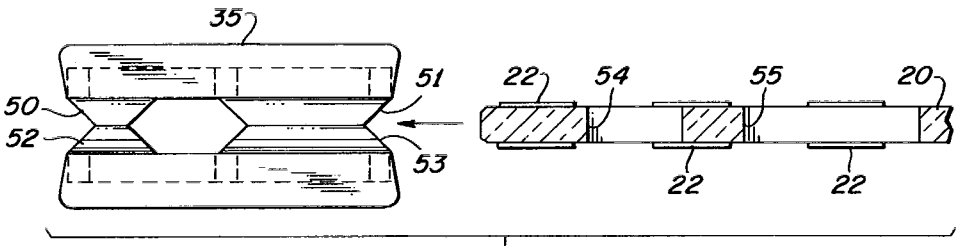
FIG. 7 is an enlarged view of a pair of the lattice structures of the apparatus of the invention showing an alternative cam means, a portion of a sectioned printed wiring board being shown just prior to its insertion therebetween in the direction indicated.

It will be appreciated that the specific interconnection apparatus according to the invention described in the foregoing is illustrative only. Accordingly, in particular applications, the details of the assembly organization may differ somewhat within the scope of the invention from those suggested in the foregoing. Thus, for example, the guide and retention members for ensuring the accurate alignment of the printed wiring board may indicate that the cam means provided at the lattice ends each comprises a pair of cams 50, 52 and 51, 53 as shown in FIG. 7. In this case, a pair of recesses 54 and 55, respectively, are provided to correspond in dimension and position in board 20 as indicated in section in the figure. In this arrangement, the long dimension of auxiliary cams 50 and 52 is determined as considerably shorter than that of cams 51 and 53. As a result, larger cams 51 and 53 slide over the board surfaces and also over smaller recesses 54 as board 20 is inserted in the direction indicated. Cams 51 and 53 are thus prevented from falling into recesses 55 until smaller cams 50 and 52 are also admitted in smaller recesses 54. Any tilting of cams 51 amd 53 into recesses 55 and possible premature electrical contacts are thus advantageously prevented.

Figure 8:
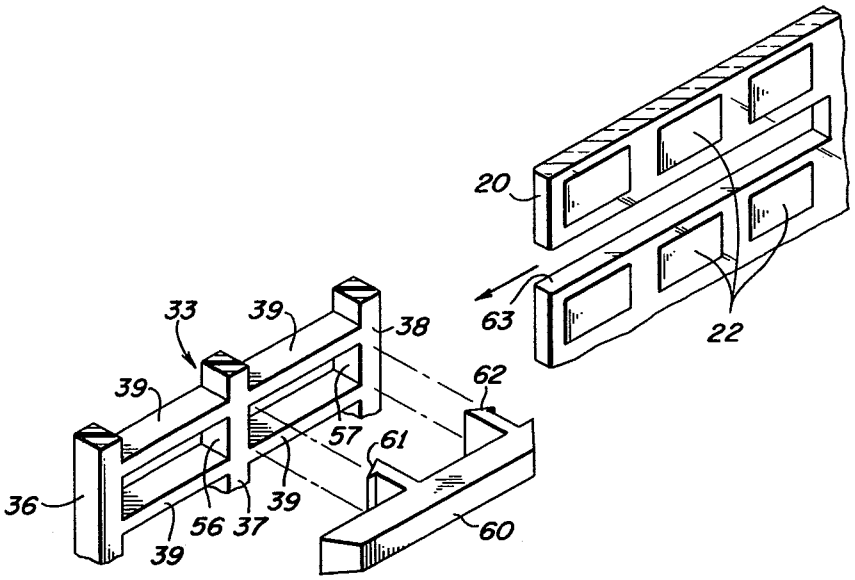
FIG. 8 is an enlarged view of a portion of the lattice structure of FIG. 4 depicting the manner of providing additional supporting cam means which may be selectively located to ensure correct insertion of a printed wiring board.

The novel lattice arrangement of the invention for supporting the housing contact springs also advantageously makes possible a secondary function. It will be appreciated that where the printed wiring board is double-sided as was the case in the illustrative embodiment described in the foregoing, it is imperative that the board be properly inserted, that is, with the proper board face in opposition to the matching contact spring array. In the past, the leading edge of a printed wiring board has frequently been selectively notched at the points of particular contact areas, the notches being so spaced and positioned along the board leading edge so that only the correct insertion of the board in its housing can mate the notches with corresponding housing tabs as is known. In FIG. 8 is shown a structure for coding the board surfaces made possible in accordance with the invention to ensure that, even with an erroneous insertion of board 20 into housing 12, erroneous electrical contacts will not result. A portion of a lattice structure 33 comprising crossbars 36, 37, and 38 and spacing members 39 define a pair of rectangular apertures 56 and 57. Two columns of such apertures are thus presented in each lattice structure. If an aperture 56 or 57 is selected which corresponds to a point on the board leading edge which is normally notched (that is, where a contact area or areas are normally omitted), a coding cam 60 may be inserted in the aperture to provide a coding function. Cam 60 may be provided with a pair of detents 61 and 62 adapted to be sprung inwardly and snapped into place to retain the cam. Cam or cams 60 then are positioned to accord with notches or recesses already presented in the board leading portion to ensure the correct and only the correct insertion of board 20 in its housing 12.

What have been described are thus considered to be only illustrative embodiments of the invention and it is to be understood that various and numerous other arrangements may be devised by one skilled in the art without departing from the spirit and scope of the invention. Thus, for example, although the rows of contact springs of the contact spring tiers and the corresponding rows of contact areas of the printed wiring board contact area arrays are shown as three in number for purposes of description, these rows in practice may include a greater or lesser number of elements. The lattice structure would then be correspondingly modified. The invention is thus limited only as defined in the accompanying claims.

We claim:

1. Electrical interconnection apparatus comprising an electrical component (20) having at least a row of contact areas (22) affixed to a flat surface thereof, a row of contact springs (e.g., 42) corresponding to said row of contact areas (22), and guide means (16, 17) for guiding said component (20) into association with said springs (42), characterized in that means are provided for ensuring a simultaneous engagement of said contact areas (22) only with said corresponding contact springs (42), said means comprising rider ends (45) terminating each of said springs (42), a lattice structure (33) for supporting said spring rider ends (45), and cam means (40) extending from said lattice structure (33) slidable along said surface of said component (20) as said component is guided into association with said springs (42) for maintaining said springs (42) out of engagement with said contact areas (22), said component (20) having recesses (46) adapted to admit said cam means (40) when said contact areas (22) and said corresponding springs (42) are in alignment.

2. Electrical interconnection apparatus comprising a fixed array of flexible contact springs (e.g., 42), a printed wiring board (20) having an array of contact areas (22) corresponding to said array of contact springs (42) affixed to a surface thereof, and guide means (16, 17) for guiding said board (20) and said array of contact areas (22) into engagement with said array of contact springs (42), characterized in means for ensuring said engagement only when the springs of said array of springs (42) and the corresponding areas of said array of contact areas (22) of said board (20) are in full alignment comprising rider ends (45) terminating each of said springs (42), and cam means (40) having crossmembers (36, 37, 38) extending therefrom for supporting said rider ends (45), end members (35) terminating said crossmembers (36, 37, 38), and second guide means (27, 31) for slidably containing said end members (35), said cam means (40) being slidable along said surface of said board (20) for maintaining said springs (42) out of engagement with said contact areas (22), said board (20) having at least a recess (46) dimensioned and positioned to admit said cam means (40) when said contact areas (22) and said corresponding springs (42) are in alignment.

3. Electrical interconnection apparatus comprising an array of flexible contact springs (e.g., 42), a printed wiring board (20) having an array of contact areas (22) corresponding to said array of contact springs (42) affixed to a surface thereof, and guide means (16, 17) for guiding said board (20) and said array of contact areas (22) into association with said array of contact springs (42), characterized in means for ensuring said engagement only when said springs of said array of springs (42) and the corresponding contact areas of said array of contact areas (22) of said board (20) are in full alignment comprising rider ends (45) terminating each of said springs (42), a plurality of crossmembers (36, 37, 38) for supporting said rider ends (45), end members (35) terminating said crossmembers (36, 37, 38), second guide means (27, 31) for slidably containing said end members (35), and a cam means (40) at the ends of said crossmembers (36, 37, 38) slidable along said surface of said board (20) for maintaining said springs (42) out of engagement with said contact areas (22), said board (20) having recesses (46) formed therein dimensioned and positioned to admit said cam means (40) when said contact areas (22) and said corresponding springs (42) are in alignment.

4. Electrical interconnection apparatus as claimed in claim 3 further characterized in a housing (12) having sidewalls (27) for containing said array of contact springs (42) and in that said second guide means comprises a channel (31) formed in said side-walls (27).

5. Electrical interconnection apparatus comprising a plurality of flexible contact springs (e.g., 42) having contact portions arranged in a coordinate array, a printed wiring board (20) having a plurality of contact areas (22) affixed to a surface thereof arranged in a coordinate array corresponding to said array of contact springs, a housing (12) having opposing side-walls (27) for containing said plurality of springs (42), and guide means (16, 17) for guiding said board (20) and said array of contact areas (22) into association with said array of contact springs (42) characterized in rider ends (45) terminating each of said springs (42), a lattice structure (33) having crossmembers (36, 37, 38) for supporting said spring rider ends (45), said lattice structure (33) being slidably fitted between said sidewalls (27) of said housing (12), and cam means (40) extending from each end of said lattice structure (33) slidable along said surface of said board (20) as said board (20) is guided into association with said array of contact portions of said springs (42) for maintaining said contact portions out of engagement with said contact areas (22), said board (20) having recesses in said surface dimensioned and positioned to admit said cam means (40) when said array of contact areas (22) and said corresponding array of contact portions of said springs (42) are in alignment.

6. Electrical interconnection apparatus as claimed in claim 5 further characterized in that each of said cam means comprises a first and a second cam (51, 50), said cams being positioned so that said first cam (51) slidably precedes said second cam (50) along said surface of said board (20), and in that said board (20) has recesses (55, 54) in said surface corresponding in position to said cams (51, 50), the configuration of said cams (51, 50) and said recesses (55, 54) being such that said first cam (51) is admittable only in its corresponding recess (55).

7. Electrical interconnection apparatus as claimed in claim 5 or 6 further characterized in that said lattice structure (33) defines a plurality of apertures (56, 57) between said crossmembers (36, 37, 38) and in that at least one coding cam (60) is provided in a selected one of said apertures (56), said board (20) also having a coding recess (63) in said surface dimensioned and positioned to admit said coding cam (60).

8. Electrical interconnection apparatus comprising an electrical circuit board (20) having at least a first and a second row of contact areas (22) affixed, respectively, to opposite flat surfaces thereof, and a first and a second row of contact springs (42, 43) corresponding, respectively, to said first and second row of contact areas (22), said springs (42, 43) having curved contact surfaces for engaging said contact areas when said board (20) is moved between said first and second row of springs, characterized in that rider ends (45) terminate each of said springs (42, 43), a first and a second lattice structure (33, 34) is provided for supporting the rider ends (45) of the springs of said first and second row of contact springs (42, 43), respectively, and cam means (40, 41) extending from each lattice structure (33, 34) toward the other, each of said cam means being slidable along said opposite surfaces of said board (20) when said board is moved between said first and second row of springs (42, 43) for maintaining said curved contact surfaces out of engagement with said contact areas of said board (20), said board (20) having at least one recess (46) dimensioned and positioned to admit said oppositely directed cam means (40, 41) when said first and second row of contact areas (22) and said corresponding curved contact surfaces of said first and second row of contact springs (42, 43), respectively, are in alignment.

9. Electrical interconnection apparatus comprising a first and a second plurality of contact springs (42, 43) arranged to present first and second opposing arrays of contacting surfaces, and an electrical circuit board (20) having a first and a second array of contact areas (22) affixed, respectively, to opposite sides thereof, said first and second arrays of contact areas corresponding, respectively, to said first and second opposing arrays of spring contacting surfaces, characterized in that rider ends (45) terminate each of the springs (42, 43) of said first and second plurality of springs, a first and a second lattice structure (33, 34) each having crossmembers (36, 37, 38) for supporting the rider ends (45) of the springs of said first and second plurality of springs (42, 43), and cam means (40, 41) extending from each end of each of said lattice structures (33) toward the other of said lattice structures (34), each of said cam means (40, 41) being slidable along said opposite surfaces of said board (20) when said board is moved between said first and second array of spring contacting surfaces for maintaining said last-mentioned contact surfaces out of engagement with said contact areas of said board (20), said board (20) having recesses therethrough (46) dimensioned and positioned to admit said oppositely directed cam means (40, 41) when said first and second array of contact areas (22) and said corresponding arrays of contacting surfaces of said first and second plurality of contact springs (42, 43), respectively are in alignment.

10. Electrical interconnection apparatus as claimed in claim 8 or 9 further characterized in a housing (12) for containing said first and second plurality of contact springs (42, 43) having side-walls (27) and guide means (31) in each of said side-walls (27) for slidably retaining said ends of said lattice structures (33, 34).

* * * * *